United States Patent [19]

DeMatteis

[11] Patent Number: 5,013,290

[45] Date of Patent: May 7, 1991

[54] SERIAL DISPENSING BAGS WHICH OPEN AUTOMATICALLY

[75] Inventor: Robert B. DeMatteis, Grass Valley, Calif.

[73] Assignee: Cupples Paper Bag Company, La Mirada, Calif.

[21] Appl. No.: 334,049

[22] Filed: Apr. 5, 1989

[51] Int. Cl.[5] ..... B31B 1/00

[52] U.S. Cl. ..... 493/196; 221/27; 221/47; 383/109; 493/201

[58] Field of Search ..... 493/194, 195, 196, 200, 493/201, 202, 204, 210, 933; 383/109; 221/22, 26, 27, 47

[56] References Cited

U.S. PATENT DOCUMENTS

| | | | |
|---|---|---|---|
| 3,184,055 | 5/1965 | Davis et al. | 206/493 |
| 4,560,598 | 12/1985 | Cowan | 383/109 |
| 4,676,378 | 6/1987 | Baxley et al. | 383/8 |
| 4,744,200 | 5/1988 | Benoit, Jr. et al. | 493/204 |
| 4,811,417 | 3/1989 | Prince et al. | 493/204 |

*Primary Examiner*—Frederick R. Schmidt
*Assistant Examiner*—Jack Lavinder
*Attorney, Agent, or Firm*—Townsend and Townsend

[57] ABSTRACT

A method for producing a serialized bundle of thermoplastic T-shirt grocery bags which serially open upon being dispensed. Specifically, a bag being removed from the serialized bundle of thermoplastic T-shirt grocery bags mounted on a dispensing rack automatically opens an immediately following and trailing bag. The bags of the serialized bundle are coextruded to have at least two layers, an inside layer having a low coefficient of friction and an outside layer having a high coefficient of friction. A relatively low coefficient of friction between two inside layers allows each bag to easily open; a relatively high coefficient of friction between the outside layers allows a leading bag to entrain a trailing bag. Entraining structures are provided into and between the respective bags which permit the bags to be keyed together at their high friction outside layers and separate at their low friction inside layers. These entraining structures may preferably include special flaps which overlie one another on a dispensing rod. A tab constraining each front wall to a wicket is either presevered or slit during the cut out operation to easily detach from the wicket so as to not overcome a self opening force which prevents the bags from opening automatically.

6 Claims, 10 Drawing Sheets

SERIAL DISPENSING BAGS WHICH OPEN AUTOMATICALLY

BACKGROUND OF THE INVENTION

This invention relates to bags. More specifically, this invention relates to an apparatus and process for manufacturing a dispensing unit of co-extruded thermoplastic T-shirt bags. In the dispensing unit of bags, a series of bags overlie one another and are interconnected for serial dispensing. When a first front bag is packed with groceries and removed from a rack containing the remainder of the dispensing unit of bags, an immediately subsequent second bag is automatically opened in preparation for loading in its own turn.

SUMMARY OF THE PRIOR ART

The manufacture and use of so-called "T-shirt" thermoplastic grocery bags has surprising complexity and is described in detail in my co-pending patent application Ser. No. 07/185,633, filed Apr. 26, 1988, the application hereby expressly incorporated by reference. Additionally, the manufacturing process of co-extruded thermoplastic bags is known and will not be further described herein.

There are two relevant prior art concepts applicable in the present invention. The first concept is co-extrusion considerations for manufacturing thermoplastic bags. The second concept is manufacturing bags so that they open automatically as they are dispensed.

Co-extrusion occurs in the manufacturing process when the initial tube of blown plastic is created. The plastic essentially has at least an inner layer and an outer layer, the two layers exhibiting different properties. Co-extrusion was implemented to address a problem existing with conventional plastic bags having a single layer. The single layer could be produced from either what is referred to as a "high density resin," a "low density resin," or some intermediate density. High density resins are those resins having a density of 0.941 $gr/cm^3$ or above of polyethylene. Low density resins are typically less than or equal to 0.925 $gr/cm^3$ of polyethylene.

If a conventional bag is produced from low density resins, the bag will become soft, pliable, and very puncture and tear resistant. However, the bag will not be very strong and will need to be relatively thick to properly support any load placed inside the bag.

If high density resins are used, the bag thickness can be reduced by half. Bags made of high density resins are strong under tensile loading, but they are crinkly and harder to the touch. However, these bags are also prone to be susceptible to what is known as straight line tearing. Straight line tearing is where the bag will tear in a straight line, usually either horizontally or vertically relative to a bag axis.

Co-extrusion is designed to maximize the advantages of both resin types. It is a lamination having both high density resin and low density resin. Low density resin is used on the outside of the bag; it is puncture and tear resistant. High density resin is used on the inside for its strength qualities.

With respect to the automatic opening of bags, it is known in the art to provide a combination of bags wherein upon dispensing a front bag, a subsequent trailing and immediately following bag is automatically opened. The reference to Baxley et al., U.S. Pat. No. 4,676,378, reveals such a combination of bags. The bags of Baxley suffer from a difficulty in that the manufacturing tolerances for producing the bags are so close that profitable production of the bags is not possible. Baxley provides for securing overlying bags together with releasable adhesive such that one bag will engage the immediately subsequent bag.

DISCOVERY

The manufacture of complex co-extruded thermoplastic "T-shirt" bags may be conducted whereby in serially dispensing a first bag from a dispensing rack, a second bag immediately subsequent the first bag is automatically opened without requiring adhesive.

A special bag is manufactured wherein there are at least two layers required, an inside layer and an outside layer. The inside layer is relatively "slippery," while the outside layer is relatively "sticky." Applicant observed that co-extruded bags made as described above exhibit these properties. That is, by having a high density film as the innermost layer and a low density film as the outermost layer, the bag is slippery on the inside and sticky on the outside.

This natural phenomenon may be utilized and enhanced by particular attention to specified manufacturing variables and thereby bags which open automatically may be produced.

Natural frictional and adhesive forces exist between these co-extruded bags which produce a tendency of the bags to be self-opening. The manner in which the bags are overlaid provide that on the inside of the bags two slippery surfaces contact one another. The reader will understand that there is a tendency for the two inside surfaces to separate. The back of a first bag contacts the front of a second bag. As these outside surfaces are sticky, there is a tendency for the back of the first bag to "hold" the front of the second bag as the first bag is dispensed. The front of the second bag is therefore pulled forward as the first bag is withdrawn. The inside surfaces of the second bag, being slippery, tend to separate, thus allowing the second bag to automatically open as the front bag is dispensed. However, there are enough forces counteracting these self-opening forces that self-opening cannot occur in conventional, co-extruded bags without modification.

It was also observed that the bags naturally drape from supporting rods and that the handles have a tendency to hang from the rods. When the bags have been mounted to the dispensing rack by inserting the rods through apertures in the dispensing units, it was noticed that the natural depending weight of the bags is supported by the top surface of the supporting rod. The apertures are not completely cut out, but rather "dog ears" are created wherein the supporting rods of the dispensing rack may be inserted through the apertures. The dog ears overlay one another when the rods are inserted. The weight of all the bags is thereby supported on the dog ears. The prior art was concerned that the collective weight of the bags would hang from the top of the supporting rod and that therefore stresses would be placed upon the top of the apertures in the handles. Baxley, for instance, requires that the apertures be oriented so that the attachment of the flap to the handle be opposite this force. Applicant realized that the increased force acting in the handles may be utilized to provide for a self-opening function. By orienting the dog ears properly with respect to the natural depending weight, the normal forces acting on the successive overlying dog ears may be increased. Increasing the normal force means that the frictional forces existing between the bags is likewise increased. This increased force may be directed to impart a self-opening force to trailing bags as forward bags are dispensed.

A further force which needs to be overcome is that of tabs provided on each of the bags which hold the bag to the wicket. The tabs are created such that both the front and the back of the bag are attached to the wicket. Thus, for the dispensed front bag to open the second bag, the force opening the second bag cannot be overwhelmingly resisted by the tab holding the front of the second bag to the wicket. The most straightforward manner of reducing the force required to sever the tab holding the front of a bag to the wicket is to sever the front tab during the manufacturing process. Thereafter, bags are sufficiently held to the wicket by the back tab only.

A more subtle approach is to manufacture the bag in such a manner that a front tab may be easily severed from the wicket. To reduce the force required to sever the front tab, the plastic's natural tendency to straight line tear may be adapted to allow the tab to be easily severed from the wicket.

SUMMARY OF THE INVENTION

A unit of thermoplastic grocery bags are manufactured, assembled, prepared for use, and dispensed in such a way that upon loading and dispensing the first bag of a serialized unit of bags, a subsequent bag in the unit is automatically opened. The bags are manufactured through use of a co-extrusion process wherein a bag has different characteristics for both the surfaces of the interior and the exterior of the bag. The bag exhibits a "slipperiness" between the interior surfaces of the bag. The bag also exhibits a "stickiness" on the exterior surfaces, allowing the bags to have a tendency to cling to one another. Co-extruded bags will exhibit these characteristics if a high density resin is used for the interior surface and a low density resin is used for the exterior surface. The reader will understand that it is the character-istics of slipperiness and stickiness which are important to the present invention, and not merely the use of specified material; this is because the natural characteristics of resins may be altered through the use of "slip" and "anti-block," as is known in the art, to increase or decrease slipperiness or stickiness. Therefore, medium density resins may be used in the interior layer if they attain the requisite slipperiness. Applicant refers to a coefficient of friction existing between portions of like layers, i.e., an inside layer portion contacting another inside layer portion, or an outside layer portion contacting another outside layer portion as a mutual coefficient of friction. Therefore, the mutual coefficient of friction exhibited by the inside layers is less than the mutual coefficient of friction of the outside layers.

The grocery bags are also provided with apertures through which supporting rods will ultimately be inserted to support the finally produced bag bundle prior to dispensing.

In a preferred embodiment, the apertures which have been created are positioned relative to the supporting rod so that the dog-ear flap contacts the top surface. In a bundle of serialized bags, the flaps will all be oriented in the same direction. When the rod is inserted through the apertures, the flaps will be forced outward and upward, such that they tend to be in a horizontal plane. The bottom most flap of the rear wall of the last bag will contact the top of the rod. Successive flaps will overlie the immediately subsequent flaps. In this fashion, the flaps all overlie one another on the top of the rod with the first flap of the first bag being the top most flap. The natural depending weight of the bags, as transferred to the handles, rests on the layers of flaps, increasing the frictional forces existing between the layers. These flaps provide an entraining means between the individual bags to be dispensed.

It is another preferred embodiment to orient the dog-ear flaps in the handles so that a normal force existing between the flaps and a supporting rod when threaded through an aperture may be increased during removal of bags to provide sufficient self-opening forces. It is understood that flaps could be oriented under the supporting rod, or at the side thereof, if a bag is to be generally urged up as it is removed.

It is one embodiment of the present invention to increase the self-opening force of the entraining means by blunting a blade which creates the dog-ear flaps. This increases the clinging effect of the outer layers.

The bags are also designed to reduce an automatic opening resisting force between a front tab of the bag and the wicket. A tab is created during manufacturing on the front and on the back of each bag and will act as a means for retaining the bags into a bundle. These tabs are fused together to form a wicket which keeps the bags in a unit having a series of bags overlying one another. The tab on the front of any given bag will resist the automatic opening of the bag as the front wall is biased to an open position. In a preferred embodiment, rollers are inserted in the interior of the tube of plastic as it is being processed, and a cutting blade slices what will become the front wall at the position immediately below the position where the front tab will be created. Therefore, once the tab is created and fused to the wicket, the front tab will not be attached to the bag body and will serve no function. Thus, the bag will be attached to the wicket solely through the use of the back tab. This prevents the front tab from resisting the self-opening forces.

Another preferred embodiment is to control the cut-out operation which creates the tabs. The tab is narrowed at a critical dimension and provided with an initial cut interior to and horizontal with respect to the tab. Creating the tab in this fashion utilizes the natural tendency the bag has to straight line tear and allows the tabs to be easily severed from the wicket while supporting the bag unit to a dispensing rack.

In operation, the bags which are created are serialized by successively stacking one on another. The outside surfaces of the bags are relatively sticky with respect to one another, and the insides of the bags slide relatively easily with respect to one another. Handles, apertures, and tabs for the bags are created during a cut-out operation, and the bags are fused together at the wicket to produce the dispensing units. The apertures create dog ears which will key the bags together when mounted on a dispensing rack. The bags are keyed together by a successive series of overlying flaps loaded by natural depending weight of the bag unit. The dispensing rack has two horizontal supporting rods extending parallel to each other in the direction in which the serialized bags are to be dispensed. The supporting rods are inserted through the apertures such that the dog ears overlie the supporting rod and the natural depending weight of the bags and the handles increase the frictional forces existing between the overlying layers of the dog ears.

A first front bag is initially opened by releasing the front tab from the wicket, if necessary, and pulling the front wall from the back wall. As the interior of the bag surfaces are relatively slippery, the walls of the bags open relatively easily and a top flap and a subsequent flap slide relatively easily. Opening the first front bag causes the first flap to draw forward sliding off the top of the layers of overlying flaps. As the first two flaps slide relatively easily with respect to one another, the second flap does not move. The second flap is attached to the rear wall of the first bag, therefore the rear wall does not move. The tab attaching the rear wall to the wicket holds the rear wall in its original position. The frictional force between the second flap and a third flap (the front flap on a second bag) also tends to retain the rear wall of the second bag. As the front wall of the first bag is urged forward and the rear wall is relatively stationary, the first front bag is opened.

After the first front bag is loaded, it is dispensed from the rack by sliding it off the supporting rods. To do this, the back tab is severed, allowing the first front bag to be removed. When it is being removed, the frictional forces between the outside back wall of the first front bag and the front wall of the first subsequent bag urge the front wall of the first subsequent bag forward.

Additionally, the frictional forces on the dog ears tend to open the front wall of the first subsequent bag as well. The second flap, being a part of the rear wall of the first bag, is slid off the layers of overlying flaps and off the rod as the first bag is removed. The second flap immediately overlies the third flap attached to the front wall of the second bag. As the second flap is being urged off the successive layers of flaps, the higher frictional forces existing between the two flaps urge the third flap forward. The urging forward of the third flap directly urges the front wall of the second bag forward. Therefore, the second bag is urged open. The forces mentioned above which tended to retain the rear wall of the first bag prior to loading are identical to the forces retaining the rear wall of the second bag.

As the front wall of the second bag is urged forward and the rear wall is retained in its original position, the second bag is opened. The two forces urging the front wall of the second bag forward are sufficient to overwhelm the retaining force of the tab attached to the front wall of the second bag.

Therefore, as the first front bag is removed, the first subsequent bag is opened as was the first front bag and becomes the second front bag which will open the second subsequent bag when the second front bag is removed in due course, et cetera. In this fashion, serial dispensing of the bags is accomplished wherein subsequent bags are opened automatically as an immediately preceding bag is removed.

Other Objects, Features, and Advantages

It is an object of this invention to disclose a process for the manufacture of plastic grocery bags which automatically open as the bag in front of it is dispensed. Accordingly, a method of manufacture of the bags and an article of manufacture is disclosed wherein a co-extruded bag having a slippery interior and a sticky exterior, and further including means for keying the bags together such as the described dog ears, and means for easily releasing the front tab of each bag from a wicket is used to achieve the expedient of a simple, cost effective, and functional grocery bag exhibiting the desired result.

BRIEF DESCRIPTION OF THE DRAWINGS

Other objects, features, and advantages will become more apparent after referring to the following specification and attached drawings in which:

FIG. 1A is a perspective view depicting a serialized bag unit mounted on a dispensing rack in anticipation of having a first bag opened and loaded;

FIG. 1B is a perspective view wherein a first bag has been opened and is being loaded;

FIG. 1C is a perspective view indicating the first bag being removed from the dispensing rack and subsequently opening the front wall of the immediately subsequent bag in preparation for loading the second bag;

FIG. 1D is a perspective view indicating the second bag being loaded, which is the same relative step as depicted by FIG. 1B, which would be followed by a step 1E similar to FIG. 1C;

FIG. 3A is a detail perspective showing the overlying nature of the dog ear flaps of the first three bags as the bags are mounted to the dispensing rack as shown in FIG. 1A;

FIG. 3B is a detail perspective showing the front wall of the first bag opened and the rear wall of the first bag retained in its prior position;

FIG. 3B' is a detail perspective depicting the relative positions of the bags' walls intermediate in time to the positions depicted in FIGS. 1B and 1C wherein the frictional force between the rear wall flap of the first bag and the front wall flap of the second bag is sufficient to bring the front wall flap forward and thereby begin to open the second bag;

FIG. 3C is a detail perspective depicting the relative positions of the aperture flaps when the bags are positioned as shown in FIG. 1C wherein the first bag has been loaded and is being removed and the rear aperture flap of the first bag has urged the front aperture flap of the second bag forward and off the layers of aperture flaps such that the front of the second bag is automatically opened;

FIG. 4 is a perspective view of one step during manufacture depicting a preferred embodiment wherein rollers have been inserted inside the tube of plastic and a blade creates a slit in the front wall of the bag at a position which will ultimately be the lower part of a front wall tab, so that when the tab is ultimately cutout, the tab will not be attached to the front of the bag, but will have been pre-severed;

FIG. 5 depicts the step of cutting and sealing a top and bottom of individual bags from a roll of preformed plastic tubing such that the slit created is positioned correctly in anticipation of the cutout operation;

FIG. 6 depicts the unit of bags after the cutout operation has been performed wherein the handles with apertures have been created; the tabs have been formed and fused into a wicket having a slot for mounting the bag unit to a dispensing, rack and showing the position of the slit with respect to the tab showing the front tab being pre-severed;

FIG. 7 depicts the serialized bag unit mounted on a dispensing rack in anticipation of having the bags loaded and dispensed serially; and FIG. 7A shows the front tab being severed from the wicket.

DESCRIPTION OF THE PREFERRED EMBODIMENT

Figure 1A:
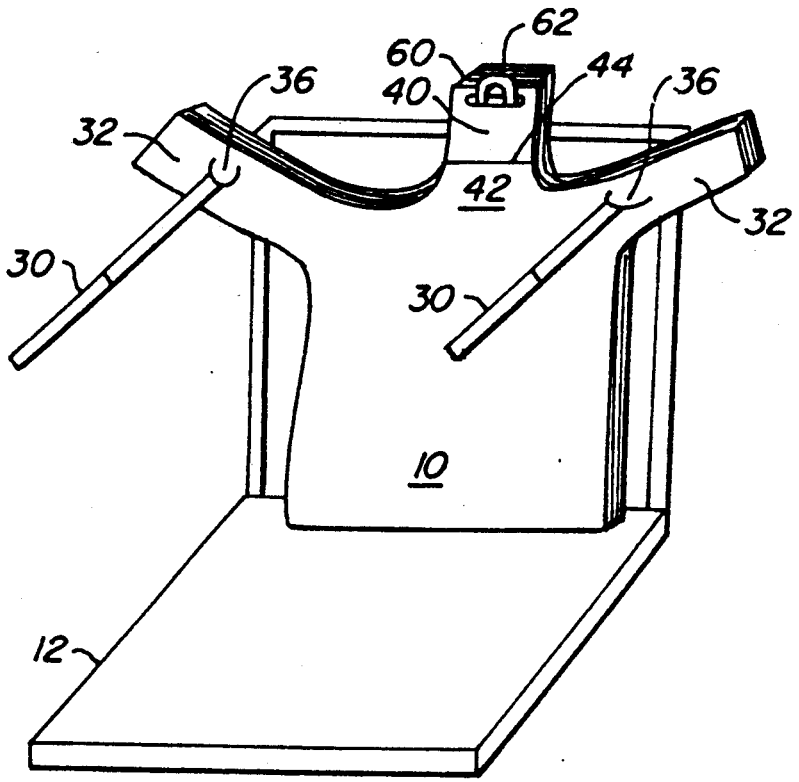
FIGS. 1A–1D are a temporal perspective indicating a preferred embodiment wherein a bag may be loaded and removed to have the immediately subsequent bag automatically opened in preparation for loading.
Figure 1B:
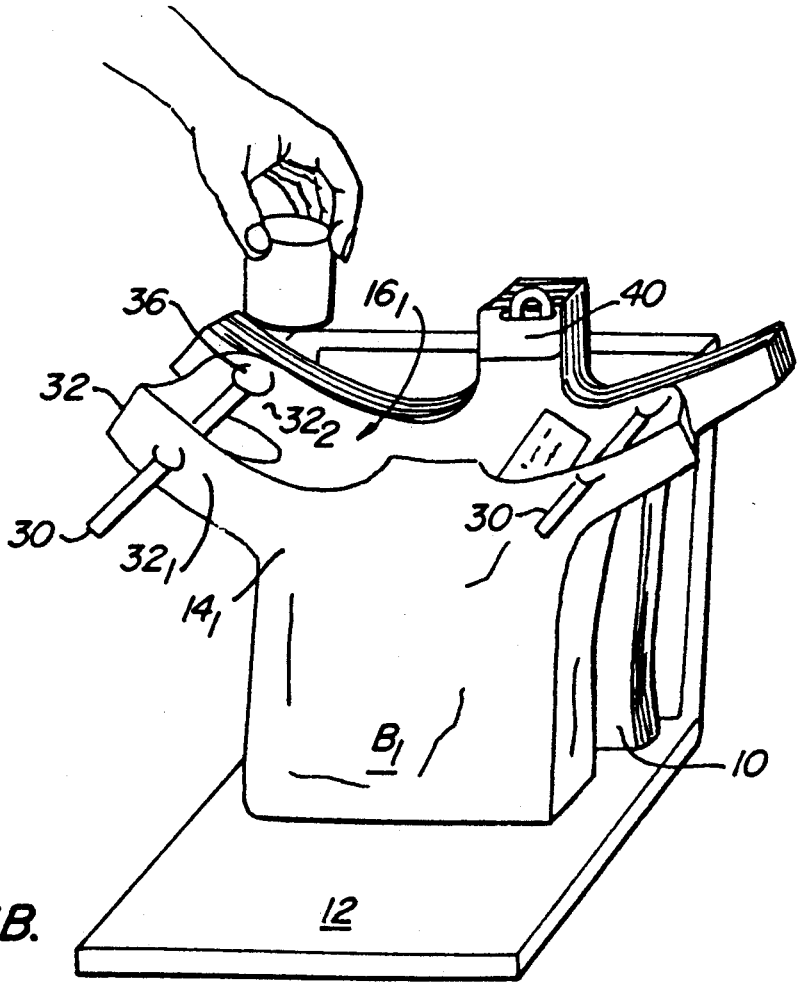
Figure 3A:
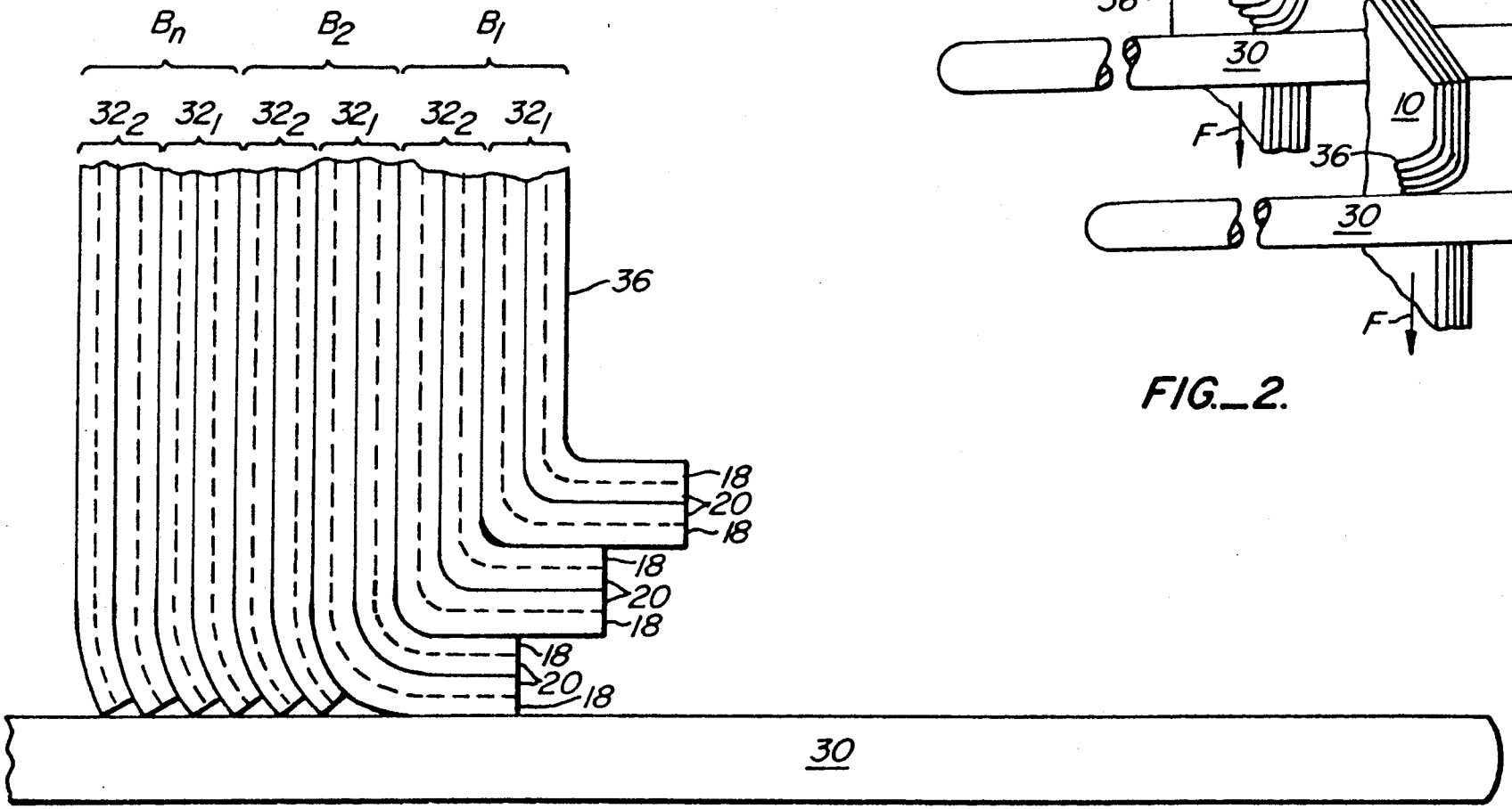
FIGS. 3A–3C are a detail temporal view of the relationship of the overlying aperture flaps to one another and to the supporting rod corresponding to the aperture relationships between the serialized bags existing in each of the FIGS. 1A–1D.

Referring to FIGS. 1A, 1B and 3A, a serialized unit of bags 10 made in accordance with this invention is shown mounted to a dispensing rack 12. Each bag $B_n$ has a front wall $14_n$ and a rear wall $16_n$. Each bag $B_n$ is produced through use of a co-extrusion process such that each wall of each bag $B_n$ has at least two layers of varying characteristics. The outside layer 18 of each wall is composed of a low density (less than or equal to 0.925 gr/cm$^3$) of polyethylene resin. These resins produce a thermoplastic which is relatively sticky and has a relatively high coefficient of friction. The inside layer 20 of each wall is composed of a high density resin (greater than or equal to 0.941 gr/cm$^3$) of polyethylene resin. These high density resins produce a thermoplastic which is relatively slippery and has a relatively low coefficient of friction. The key characteristics in the embodiment is the relative stickiness and slipperiness of the various layers. It is known in the art to use additives known as anti-block and slip to make medium density resins of polyethylene (0.927–0.940 gr/cm$^3$) produce a thermoplastic stickier than it would otherwise be. Therefore, it is relatively unimportant from what type of resin a particular layer is produced from. The important thing is the characteristics of the actual layers produced.

The reader will understand by reference to FIG. 3A that the serialization of the bags in bag unit 10 and the structure of the various layers of the walls of the bags creates two distinct types of boundaries. First, there is the boundary between each of the bags $B_n$. This boundary has two outside layers 18 contacting each other with their relatively high coefficients of friction. A second boundary exists between the inner layers 20 wherein relatively low coefficients of friction make the layers 20 slide relatively easily. Applicant identifies such coefficients of friction as mutual coefficients of friction.

The dispensing rack 12 has supporting arms 30 from which handles 32 are supported. The supporting rods 30 are inserted through dog ears $36_n$. FIG. 3A shows successive flaps $36_n$ overlying one another and a supporting rod 30. It must be remembered that the handles 32 have been created in the side walls where the tube has been "W-folded" and is therefore double thickness. As shown in FIG. 3A, it takes four layers of polyethylene in the handles 32 for each single bag $B_n$. There is therefore a front handle $32_1$ composed of a dual layer of plastic. There is also a rear handle $32_2$ composed of a double layer of plastic.

Figure 2:
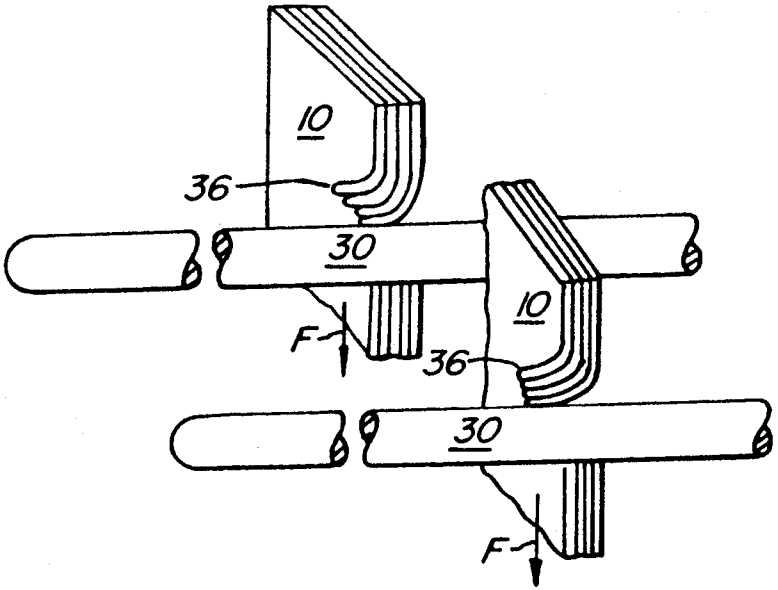
FIG. 2 is a side elevation cutout perspective showing the relationship between the dog ear aperture flaps and the supporting rod indicating the overlying nature of the flaps.

Each flap $36_n$ is oriented during the cutout operation such that when the bag handles 32 are inserted through the apertures created by the flaps 36, the weight distribution causes the bag $B_n$ to be supported by the supporting rods 30 such that the flaps 36 are directly on the top of the rod 30. This orientation maximizes a normal force F acting on the flaps 36 caused by the weight of the bags 10, as shown in FIG. 2. By maximizing the normal force F, the frictional forces exerted between the layers 18 and 18, and 20 and 20 are also maximized, and these frictional forces provide a means for keying a preceding bag with a subsequent bag.

A preferred embodiment to increase the force which keys the bags together is to blunt a blade which creates the dog ear apertures. By blunting the blade, increased keying force is supplied to the bags and thereby automatic opening may be accomplished.

A force which tends to resist self-opening is the connection of the front wall 14 to a wicket 40. A front wall 14 is connected to the wicket by a tab 42. Tabs 42 connecting each front wall 14 to the wicket 40 will tend to keep the front wall 14 from opening. If the opening forces are not sufficient to sever the tab 42, then self-opening cannot occur. Therefore, in one preferred embodiment, the step of creating slit 44 is carefully controlled. By making the tabs 42 and the wicket 40 sufficiently narrow, and by making the slit 44 perfectly horizontal and sufficiently close to the edge of the tab 42, a tab 42 which easily severs may be made. The bags $B_n$ have a natural tendency to straight line tear in the horizontal direction. By making the slit 44 as described, the front wall 14 may be easily severed from the wicket 40 and the wicket 40 will still hold the bags $B_n$ securely together as a dispensing unit 10.

Another preferred embodiment is to "pre-sever" the tabs 42 connecting the front walls 14 to the wicket. By this simple expedient, there is no longer any force exerted by the tab 42 connecting a front wall 14 to the wicket 40 preventing the bag $B_n$ from opening. This means that self-opening forces will be sufficient to automatically open the bags $B_n$.

Figure 6:
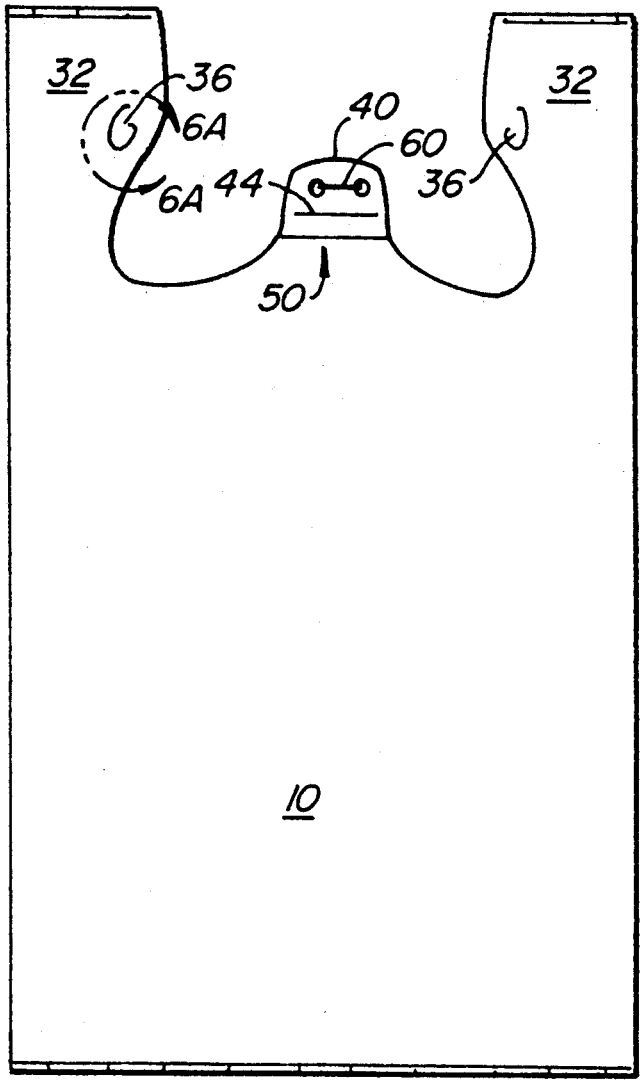
Figure 6A:
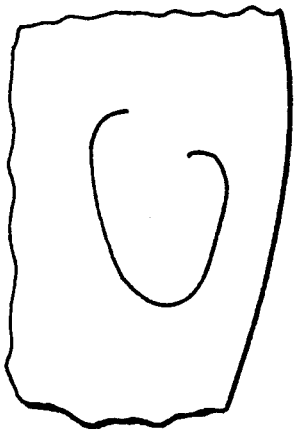
FIG. 6A is a detail view of a dog-ear flap showing its orientation with respect to a handle in a preferred embodiment.
Figure 7:
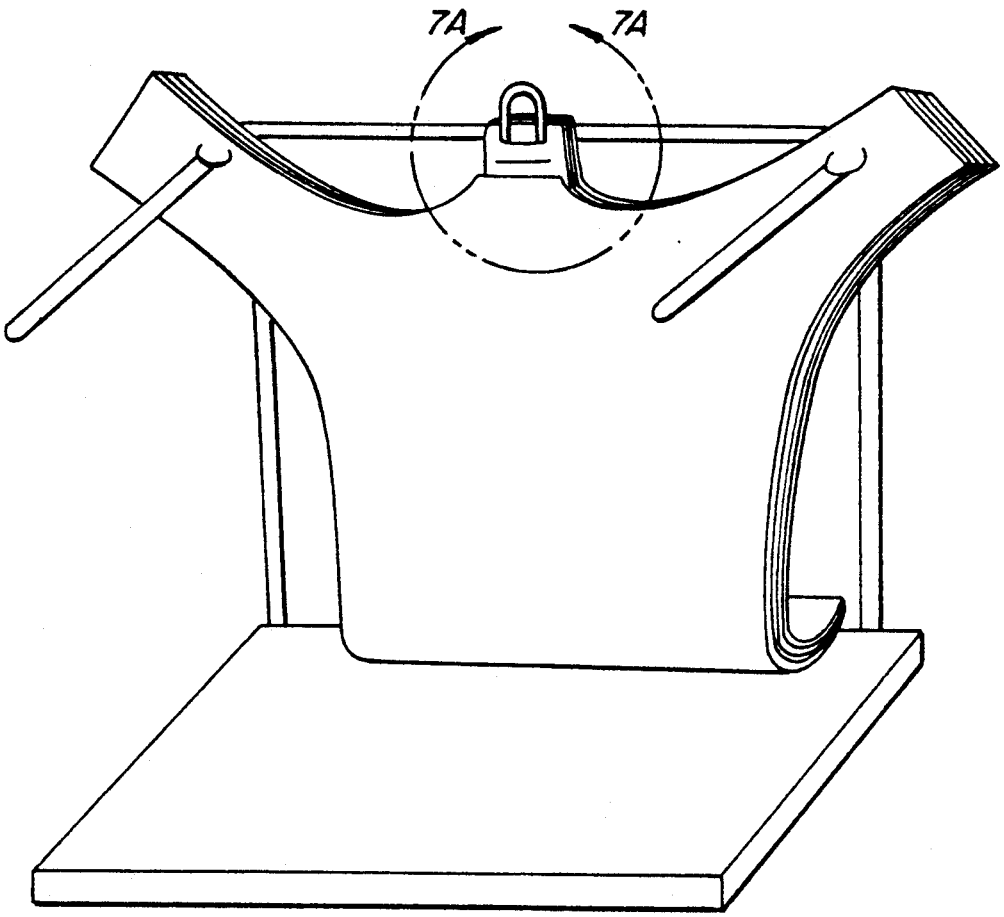
Figure 7A:
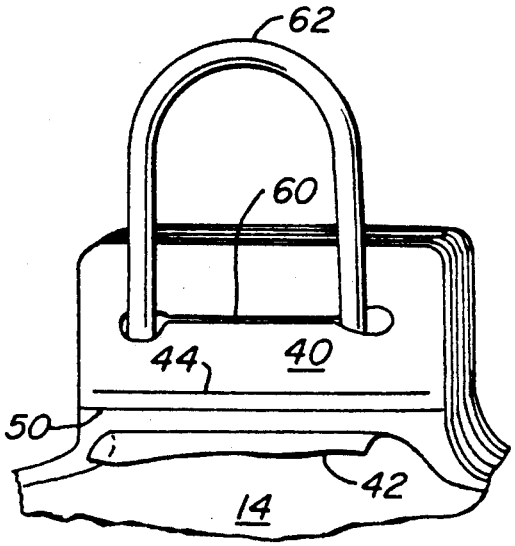

Pre-severing is shown in FIGS. 4–7A. A cut 50 is made by blade 52 in what will become a front wall 14. The cut 50 is only made in the front wall 14 and not in a back wall 16 and is made every 24" as that is the preferred bag length. It is possible to only make cut 50 in the front wall 14 by the expedient of inserting rollers inside the blown plastic tubing and thereby separate the walls of the tubing. The bags $B_n$ are formed by severing each bag at a heat seal 54 properly positioned with respect to cut 50. After the bags are formed, they are serialized into bag units 10'. Bag units 10' are all oriented so that they overlie each other and the cut 50 is similarly oriented. When the cutout operation is performed, the bag unit 10' is transformed into bag unit 10 (as shown in FIG. 6). In one operation, handles 32 are created, dog ear apertures 36 are formed, and wicket 40 is made. Wicket 40 is made by cutting tabs 42 and fusing them together into one unit. The cut 44 is made and slot 60 is punched in the wicket to allow the bag unit 10 to be attached to the dispensing rack 12 at hook 62. As shown, cut 50 completely traverses the thickness of the front tab 42 holding the front wall 14 to the wicket, thereby severing the tab 42 from the wicket 40. As clearly shown in FIG. 7A, the tab 42 is completely severed from the wicket 40, leaving the front wall 14 unattached. As noted in the previous embodiment, if proper attention is made in the manufacturing of slit 44, it is not necessary to make cut 50. Otherwise, the two embodiments are equivalent.

In operation, the bag unit 10 is mounted to the dispensing rack 12 as shown in FIG. 1A. Supporting rods 30 are inserted through dog ear apertures 36 and slot 60 is attached to hook 62. A first bag $B_1$ is opened by severing the first front wall $14_1$ from the wicket 40 and drawing the front wall $14_1$ forward. Drawing the front wall $14_1$ forward draws a first front handle $32_1$ forward as well, thereby allowing the bag to open.

Figure 3B:
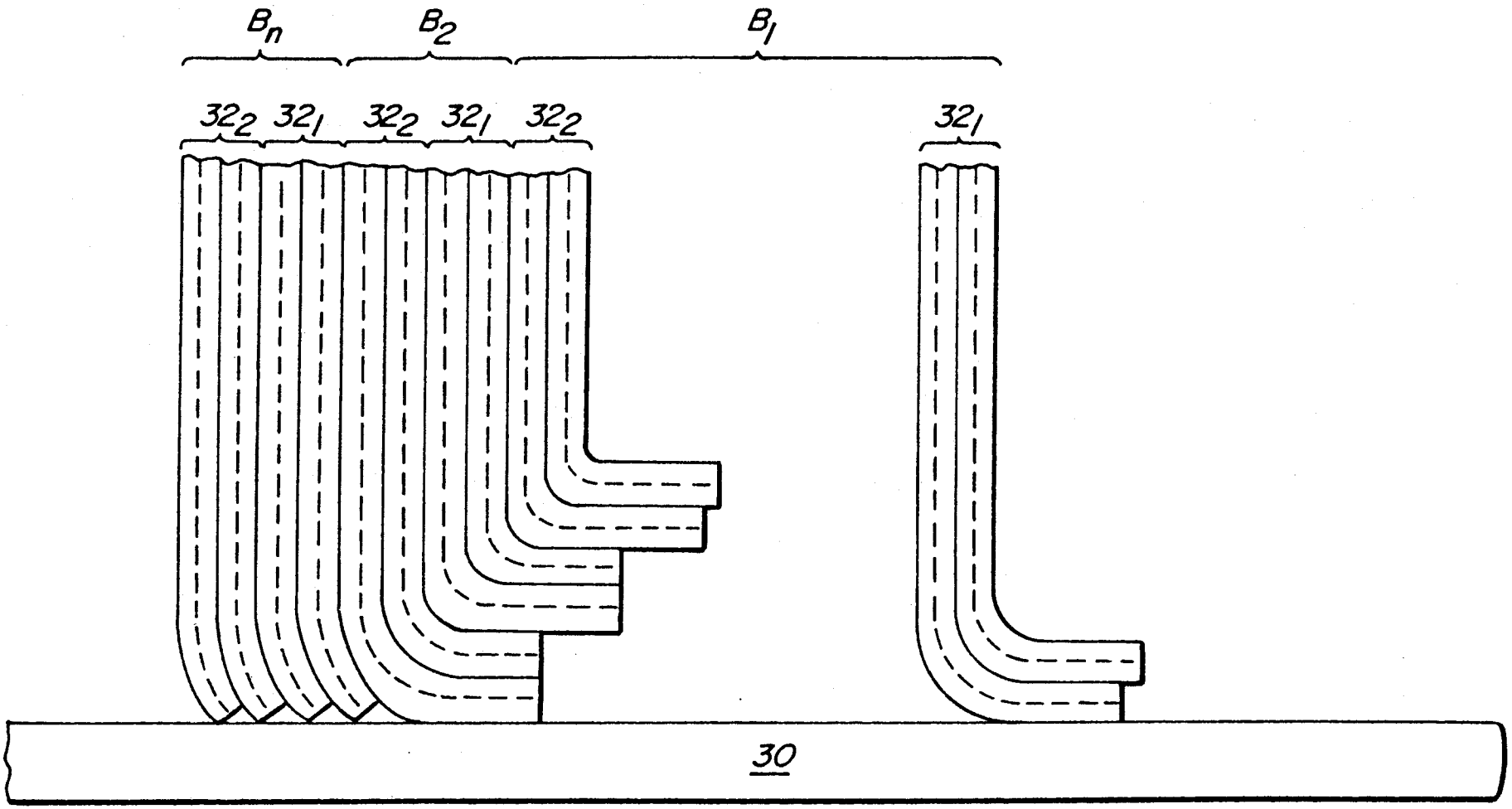
Figure 3B:
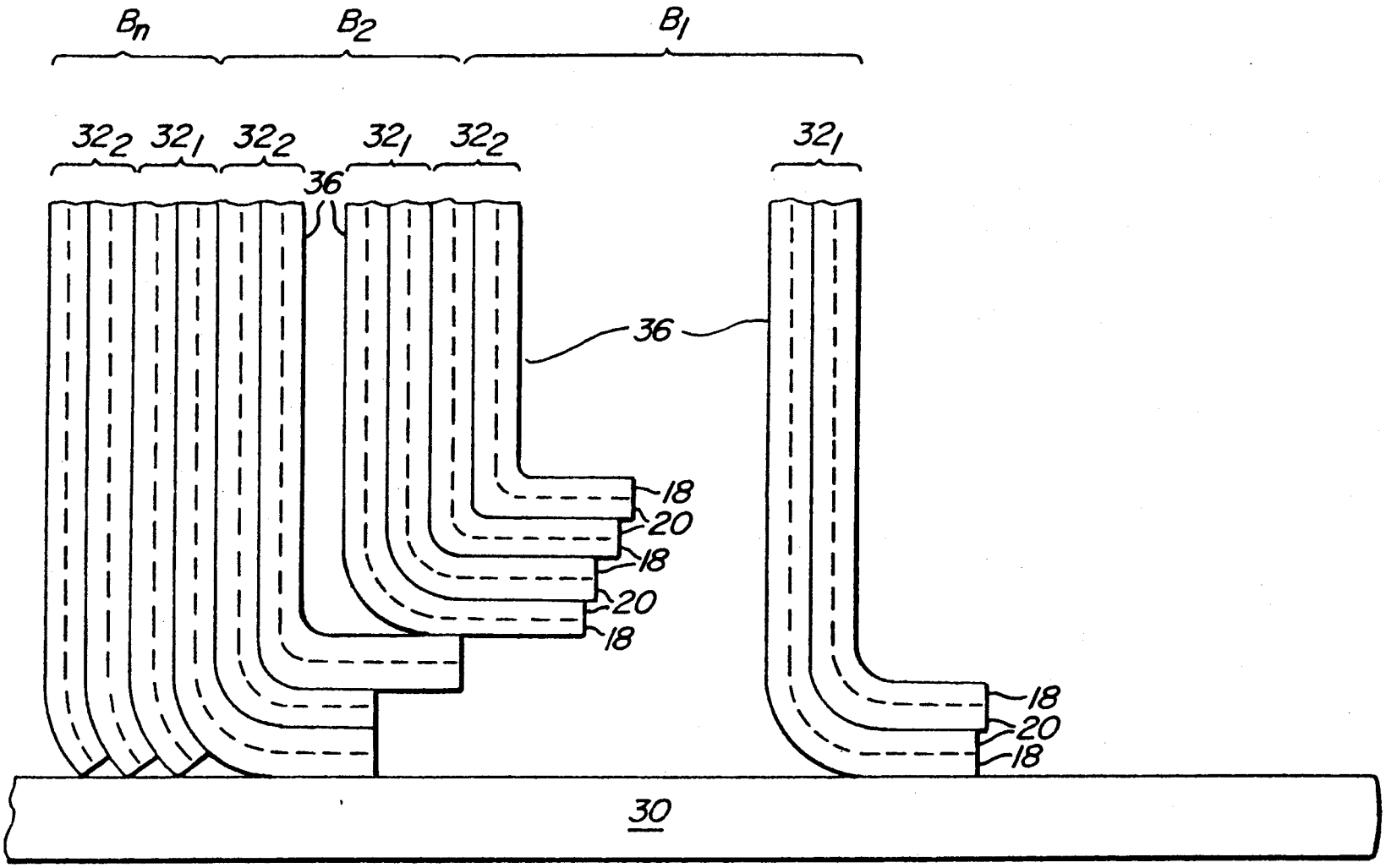

The rear wall $16_1$ remains in its original position. The rear wall $16_1$ is retained in its original position due to two forces. The first is a frictional force holding a first rear handle $32_2$ to a second front handle $32_1$. The overlying flaps 36 create sufficient force to hold the first rear handle $32_2$ in its original position, as is shown in FIG. 3B. The second force is the retentive force of a first rear tab 42 holding the rear wall $16_1$ of the first bag $B_1$ to the wicket 40.

Figure 1C:
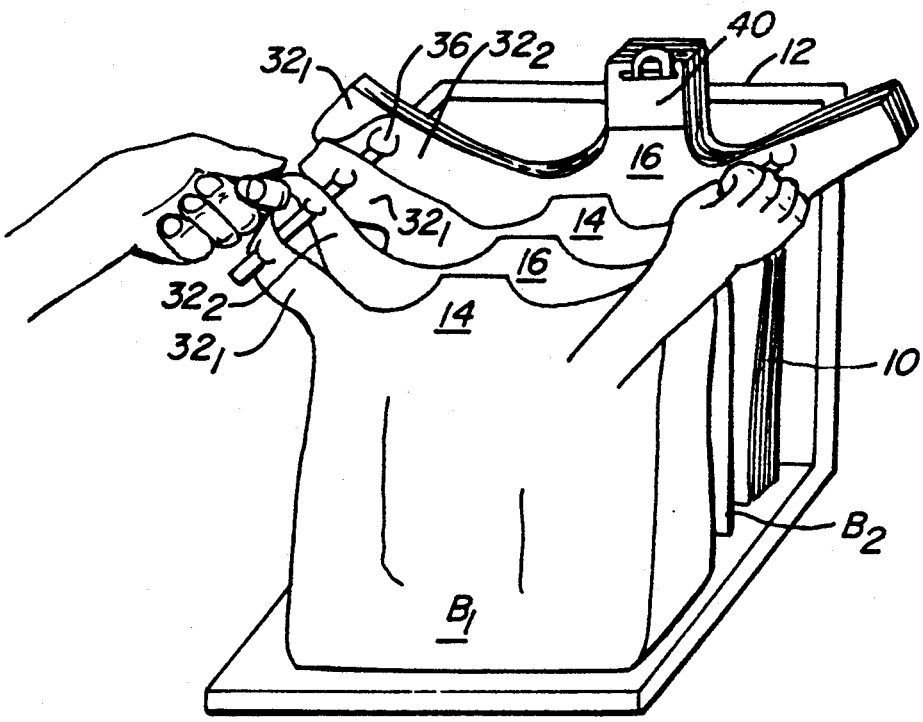
Figure 1D:
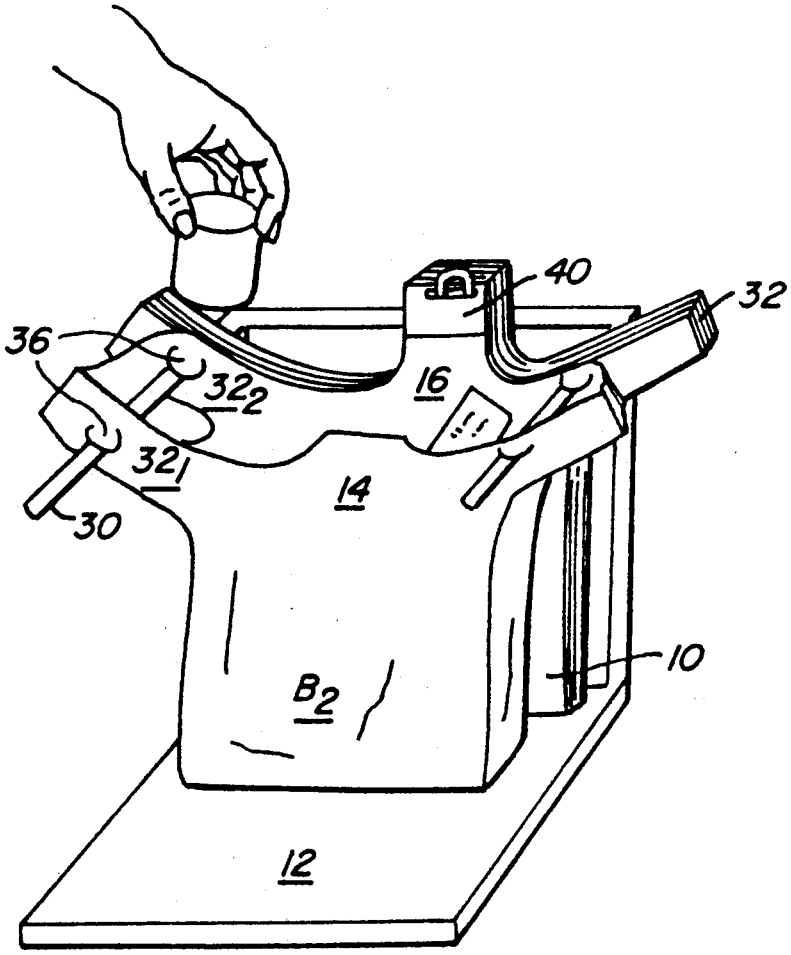
Figure 3C:
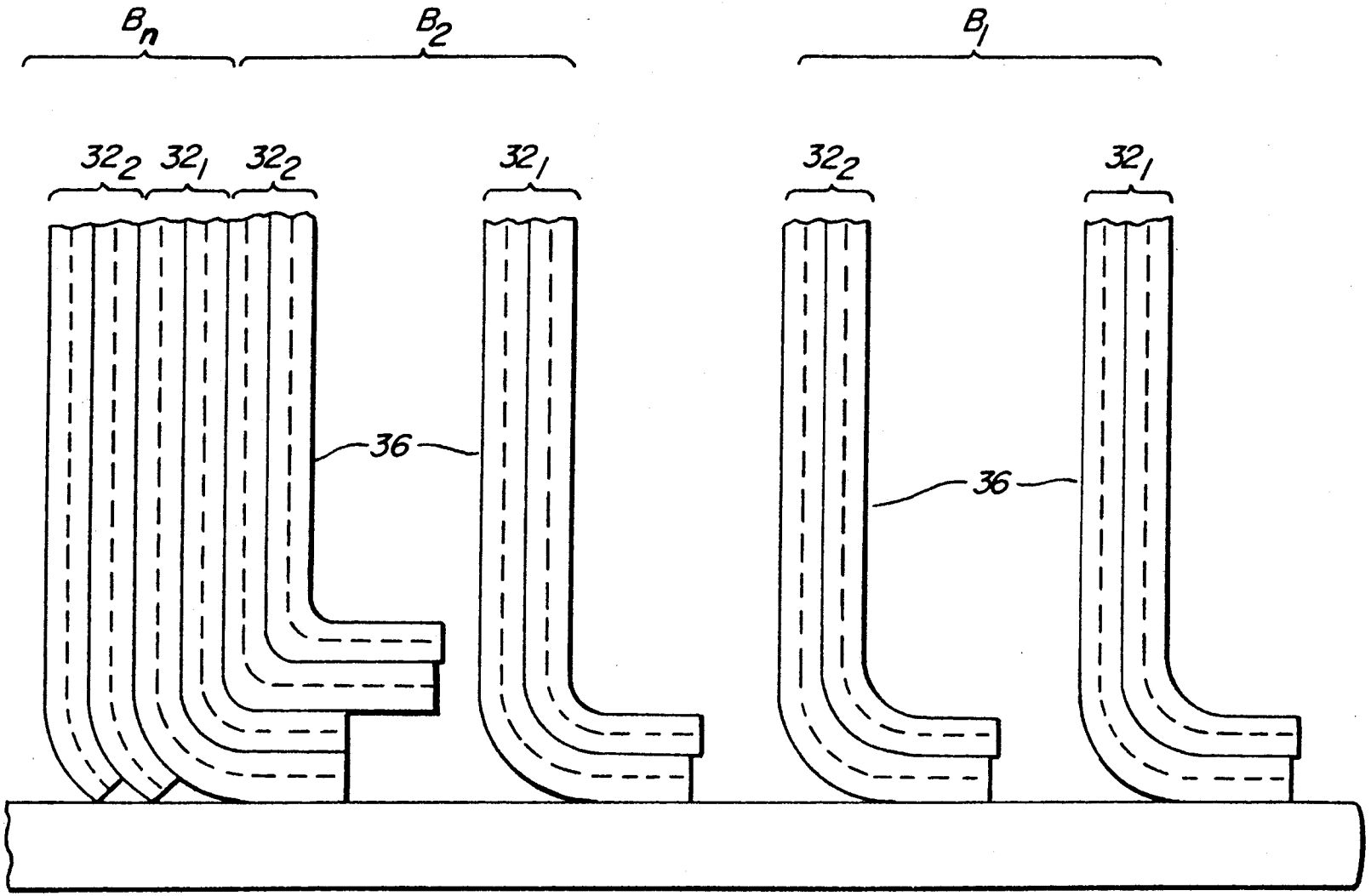
Figure 4:
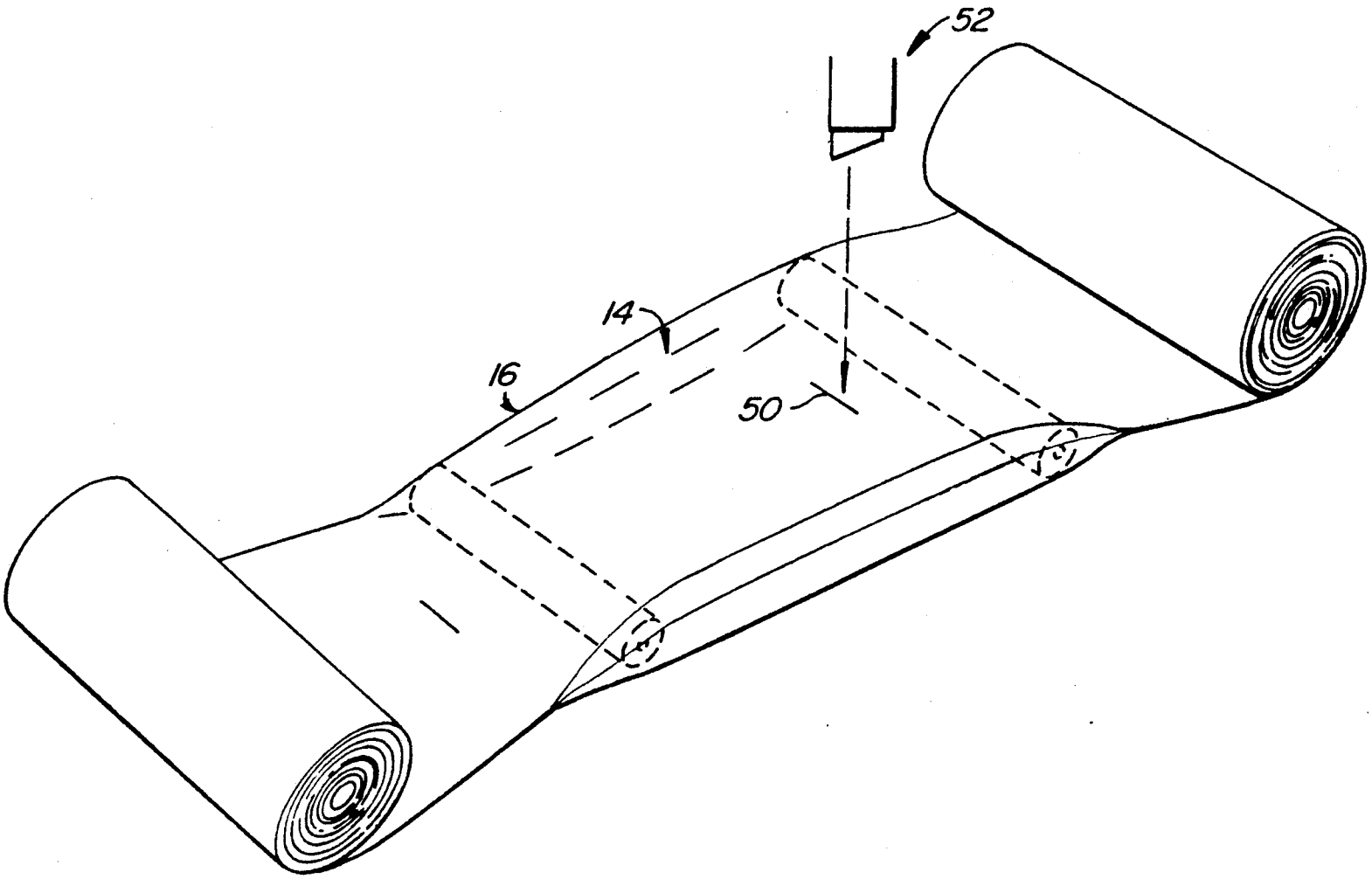
FIGS. 4–7A are perspective views of selected steps of the bag manufacturing and dispensing process depicting a preferred embodiment of "pre-severing" a tab which holds the front wall of each bag to a wicket, thereby reducing the force which a front bag must exert on a subsequent bag to automatically open the subsequent bag.
Figure 5:
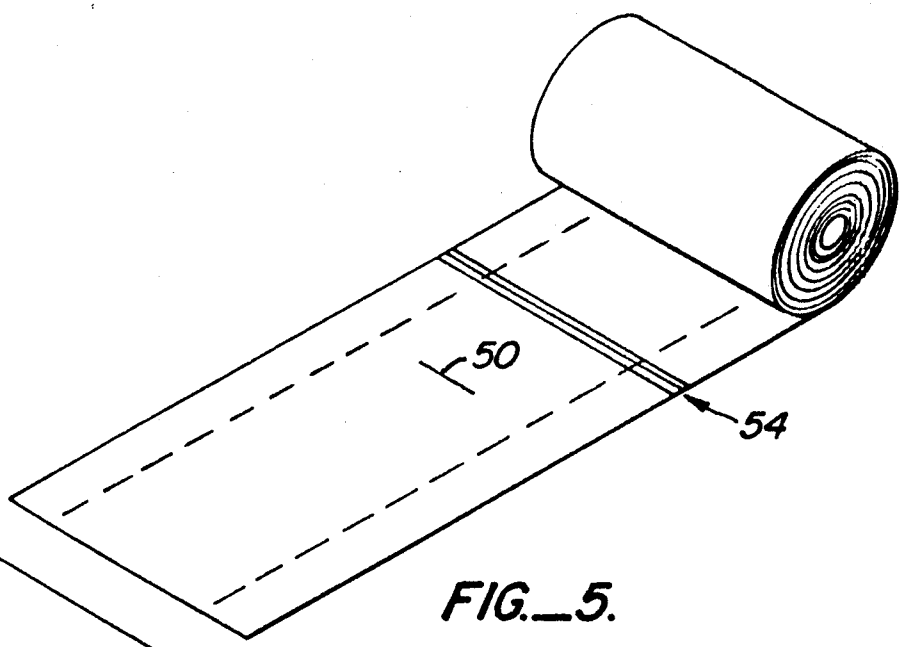
Figure 5A:
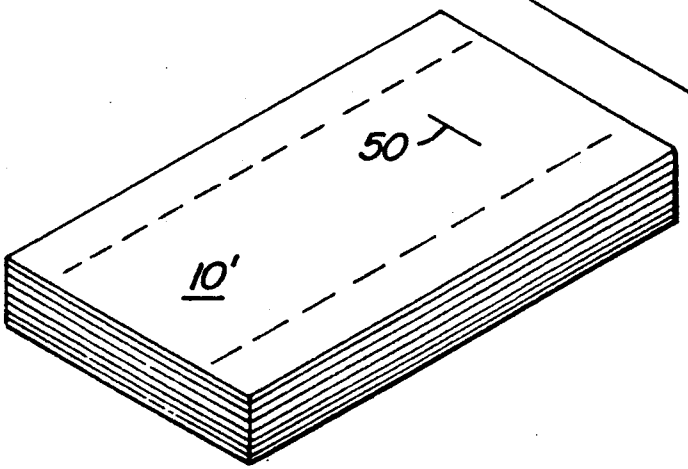
FIG. 5A depicts the serialization of the bags into stacks, all having their slits aligned.

The first bag $B_1$ may now be loaded. After the bag $B_1$ is sufficiently loaded, it is to be dispensed and presented to the customer. FIGS. 1C and 3C indicate the preparation for the dispensing of the bag $B_1$. The tab 42 securing the rear wall $16_1$ to the wicket 40 is easily severed by pulling the bag $B_1$ further forward. The handles 32 are lifted off the rack and the loaded bag is presented to the customer. In drawing the bag $B_1$ further forward, the immediately subsequent bag $B_2$ is automatically opened and presented for loading in its own turn.

The manner whereby this was accomplished is depicted in FIG. 3B', an intermediate step between the steps shown in FIGS. 3B and 3C. Pulling the first handle 32 forward brings forward both the first set of flaps 36 in the first front handle $32_1$ and a second set of flaps 36 in the first rear handle $32_2$. The second set of flaps 36 contact a third set of flaps 36 in a second front handle $32_1$. A boundary between the second and third flaps 36 has two sticky layers 18 contacting one another. As the flaps 36 have been oriented to overlie the rod 30 and to support depending weight of the bag unit 10, the frictional force is increased. In fact, the frictional force is increased sufficiently that upon drawing the first rear handle $32_2$ forward and drawing the second set of flaps 36 forward, the third set of flaps 36 are drawn forward, which in turn draw the second front handle $32_1$ forward. Drawing the second front handle $32_1$ forward urges the second front wall $14_2$ forward, creating a self-opening force. The self-opening force is sufficient to release the tab 42 holding the second front wall $14_2$ to the wicket 40. The self-opening force is sufficient for either of two reasons. The first is that the front tabs have been pre-severed, thereby no longer can they resist the self-opening force. The second reason is that the slit 44 is manufactured as described above and the closely horizontal positioning allows the natural tendency of the plastic to straight line tear to be used to easily sever the tab 42 from the wicket 40.

As the self-opening force is not resisted by any sufficient forces, the front wall $14_2$ is opened while the rear wall $16_2$ is retained in its original position. Thus, $B_2$ is automatically opened in preparation for loading.

The process is continued as serial bags are alternately loaded and dispensed and automatically open a subsequent bag as the preceding bag is removed.

While the above provides a full and complete disclosure of the preferred embodiments of the present invention, various modifications, alternate constructions and equivalents will occur to those skilled in the art given the benefit of this disclosure. Thus, the invention is not limited to the specific embodiments described herein, but as defined by the appended claims.

What is claimed is:

1. A method for producing a serialized bundle of thermoplastic T-shirt grocery bags for dispensing from a supporting dispensing rack, said method comprising the steps of:

providing said dispensing rack having a pair of supporting rods protruding horizontally outward from said rack and a defined supporting member supported from said rack intermediate said supporting rods;

providing a tube of blown thermoplastic for forming bag units having an inside layer disposed to the inside of a bag unit to be formed with a first relatively low coefficient of friction between inside layers of said bag unit, and an outside layer disposed away from said bag unit to be formed with a second relatively high coefficient of friction between outside layers of said bag units, said high coefficient of friction being greater than said first relatively low coefficient of friction;

sealing, severing, and stacking said tube at predetermined lengths to dispose said bag units into a bundle for common support from said dispensing rack;

performing a T-shirt bag cut out operation with respect to said bundle to define paired handles in each said bag section with a tab unit defined therebetween;

cutting in each handle an aperture including a flap, said flap oriented so that when threaded to said pair of supporting rods of said rack said flap is disposed away from the mass of said bags to pass the weight of said bundle downward and onto said rods through overlapped flaps on said rods;

fusing said bundle of discrete bag units together at tab units to provide a common wicket for support from said defined supporting member;

attaching said wicket of said fused bundle of bag units to the supporting member of said racks;

threading said fused bundle of bag units at said aperture in said handles to said rods of said rack;

dispensing bags serially from said wicket whereby each serially dispensed bag readily separates at said aperture including said flap to open said bag due to the low coefficient of friction of said inside layers of said flap on said supporting rod of said rack and each said bag when removed from said rack entrains a serially trailing bag due to said higher coefficient of friction of flap on said supporting rod of said rack of the dispensed bag with respect to the serially trailing bag.

2. In a method of producing a serialized bundle of a plurality of thermoplastic T-shirt grocery bags including the steps of:

providing a tube of blown thermoplastic which is flattened and sized by sealing and severing at predetermined lengths, stacking and cutting said bags to form a pair of handles in each said bag, cutting a hole in each said handles for supporting, said serialized bag bundle at said hole in said handles; and, providing a dispensing rack, said rack having a pair of supporting rods protruding horizontally outward from said rack for the support of said serialized bundle of bags at said cut holes in said handles;

dispensing serially said bags from said dispensing rack, the improvement to said providing a tube of blown thermoplastic and cutting a hole in each said handle comprising the improved steps of:

providing the tube of blown thermoplastic with inside surfaces having a first relatively low coefficient of friction therebetween and outside layers having a second relatively greater coefficient of friction therebetween which is greater than said coefficient of friction; and cutting out the hole in the handles to define a disposed flap, said flap oriented so that when threaded to said supporting rods of said rack the flaps of serial bags in said bundle have the weight of said bags bear on the said rods through said flaps whereby each serially dispensed bag readily separates at the inside surfaces of said bag at said flap due to the low coefficient of friction of the inside layer of said bag and each serially dispensed bag entrains a following serially dispensed bag due to the high coefficient of friction of the outside of said bags.

3. The improved method of claim 2 wherein said inside layer is formed from a resin having a density of about 0.941 grams per cubic centimeter or greater and said outside layer is formed from a resin having a density of about 0.925 grams per cubic centimeter or less.

4. The improved method of claim 2 wherein said inside layer is formed from a resin having a density of about 0.927 to about 0.940 grams per cubic centimeter which has been modified to provide a thermoplastic having said second coefficient of friction greater than a coefficient of friction which would be provided absent said modification and said outside layer is formed from a resin having a density of about 0.925 grams per cubic centimeter or less.

5. The improved method of claim 2 wherein said inside layer is formed from a resin having a density of about 0.941 grams per cubic centimeter or greater and said outside layer is formed from a resin having a density of about 0.925 grams per cubic centimeter or less.

6. The improved method of claim 2 wherein said inside layer is formed from a resin having a density of about 0.927 to about 0.940 grams per cubic centimeter which has been modified to provide a thermoplastic having said second coefficient of friction greater than a coefficient of friction which would be provided absent said modification and said outside layer is formed from a resin having a density of about 0.925 grams per cubic centimeter or less.

* * * * *